United States Patent [19]

Anderson

[11] Patent Number: 4,457,640

[45] Date of Patent: Jul. 3, 1984

[54] BODY WASH PAD FOR BATHING

[76] Inventor: Janice L. Anderson, 2302 13th Ave., Oakland, Calif. 94606

[21] Appl. No.: 382,467

[22] Filed: May 27, 1982

[51] Int. Cl.[3] ..... A47K 7/03; A46B 5/04

[52] U.S. Cl. ..... 401/7; 401/201; 15/227; 15/104.94

[58] Field of Search ..... 15/104, 94, 227; 401/7, 401/6, 8, 196, 200, 201; 273/DIG. 30

[56] References Cited

U.S. PATENT DOCUMENTS

| | | | |
|---|---|---|---|
| 1,688,374 | 10/1928 | Belfry | 15/227 |
| 1,713,065 | 5/1929 | Williams | 15/227 |
| 1,941,320 | 12/1933 | Pamplin | 15/227 |
| 2,210,754 | 8/1940 | Frank | 15/227 |
| 2,569,067 | 9/1951 | Livshin | 15/227 |
| 2,756,448 | 7/1956 | Werbe | 15/227 |
| 3,608,708 | 9/1971 | Storandt | 15/227 |
| 4,154,542 | 5/1979 | Rasmason | 15/227 |
| 4,228,834 | 10/1980 | Desnick | 401/201 |
| 4,247,097 | 1/1981 | Schwartz | 273/DIG. 30 |

*Primary Examiner*—Chris K. Moore
*Assistant Examiner*—Michael Knick
*Attorney, Agent, or Firm*—Bielen & Peterson

[57] ABSTRACT

A body wash pad for bathing, the pad being constructed of a decorative terry cloth outer casing and a water absorbant core, the casing has a terry cloth lined, closeable pocket for insertion of a bar of soap or for inclusion of a capful or squirt of liquid soap, the terry cloth lined pocket providing a moderate abrasive action when the pad is squeezed which generates a rapid lathering of a soap foam.

6 Claims, 3 Drawing Figures

BODY WASH PAD FOR BATHING

BACKGROUND OF THE INVENTION

This invention relates to a body wash pad for bathing that is an improvement over a conventional wash cloth. The wash pad is designed to make bathing more efficient and more enjoyable. The wash pad is particularly designed for children to encourage them to bathe in a more thorough manner than is common. Conventional wash cloths are difficult to use by children, who generally attempt to bunch them in a ball when rubbing their bodies. Usually part of the cloth flops free and becomes an annoyance occasionally splashing soap in the child's eye. Often a child will complete an entire bath with a conventional wash cloth without ever touching the soap to the cloth. Additionally, a child attempting to use a conventional soap bar will result in the child only partially soaped, with the soap hazardly resting at the bottom of the tub or shower. These disadvantages of a conventional wash cloth, particularly when used by a child, are resolved by the present invention.

SUMMARY OF THE INVENTION

The wash pad of this invention is a decorative, useful item that can be made in a variety of colors and shapes. The pad includes a convenient loop allowing the pad to be hung on conventional hooks for drying and easy access. The wash pads are constructed with a sponge core and a terry cloth covering, or core. The terry cloth case is fabricated with a pocket equipped with a closure. The pocket provides a container for soap, particularly soap remnants that would otherwise be discarded.

Alternately, liquid soap can be poured into the pocket for dispersion throughout the sponge and material of the case. The entire pocket is lined with a terry cloth or other mildly abrasive material to generate a foaming action on the soap when the pad is rubbed or squeezed. By being contained within the pocket, soap is more easily disbursed throughout the pad working its way outwardly, thus providing a continuous supply throughout the bathing. Additionally, the soap is not washed away when the pad is dropped. Because of the inner sponge core, the entire pad will float, and therefore, be easily locatable in a filled tub. Those and other advantages will become apparent upon a detailed consideration of the preferred embodiments.

DESCRIPTION OF THE PREFERRED EMBODIMENTS

Figure 1:
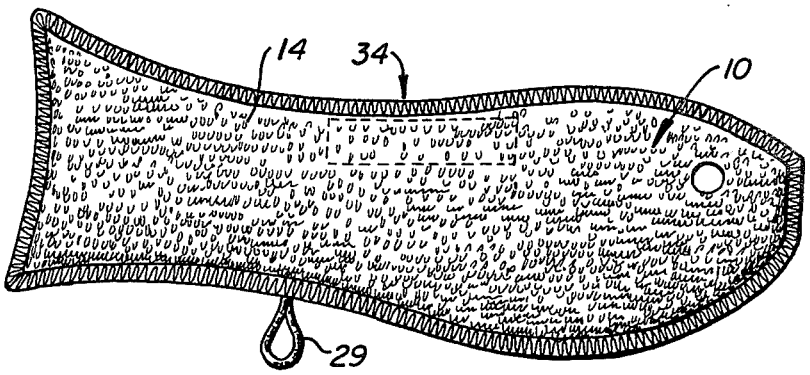
FIG. 1 is a side view of the wash pad in the ornamental form of a fish.

The wash pad of this invention is constructed primarily for bathing and is an improved substitute for a conventional wash cloth. This wash pad may, however, be used for bathing animals, washing cars, or for other uses where a sponge is commonly employed. As shown in FIG. 1, the wash pad, designated generally by the reference numeral 10, is fabricated in an ornamental configuration of a fish. It is to be understood that the configuration may be in a variety of ornamental or geometric shapes such as animals, articles such as baseballs or baseball mitts or simply squares, circles, hexagons, or other shapes which are appealing to adults or children.

The wash pad 10 is fabricated from a terry cloth casing 14 or other cloth suitable for washing. The outer casing 14 covers an inner sponge material 16 which absorbs and holds water and cleanser for use during bathing. The inner sponge material 16 is preferably of a porous, padlike composition and cut to the general configuration of the outer casing 14. The sponge material may, however, be of a particle consistency providing a filler to a partially constructed casing prior to completing the casing enclosure.

Figure 2:
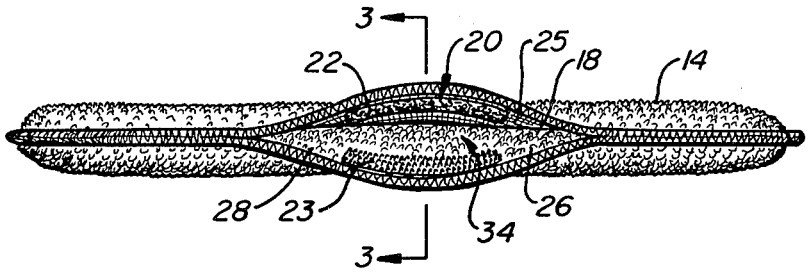
FIG. 2 is a top view of the pad of FIG. 1 with a soap pocket opened.

Referring to FIG. 2, the wash pad is constructed with a pocket 18 or internal compartment. The pocket 18 has a closure 20, which in the preferred embodiment comprises a Velcro® fastener. The closure 20 is formed with a synthetic matte or pile strip 22 sewn on one side of the pocket opening and a synthetic, filament-hooking strip 23 sewn on the other side. When pressed together, the strips mutually adhere closing the pocket. The pocket receives the cleanser, which is a bar soap or a liquid preparation, and provides for internal foaming.

The particular construction of the pocket is designed to generate immediate foaming by action of the inner pile 24 of the terry cloth material and a nylon webbing 25 on one side of the pocket and the outer pile 26 of a terry cloth liner 28, which covers the pad material 16, on the other side of the pocket. By this construction, the cleanser does not initially contact the absorbant sponge material, but must flow through the protective liner. The relatively rough surface of the terry cloth pile in contact with the intervening open webbing 26, which aids in intersurface shear slippage, causes immediate foaming when the pad is rubbed or squeezed.

The foam of the cleanser both penetrates the terry cloth casing and permeates the internal foam material providing a relatively long lasting washing aid during bathing. The outward direction of foam travel during use virtually eliminates the need to resoap the pad during use even when the pad is dropped into the water of the tub or is used during a shower.

Figure 3:
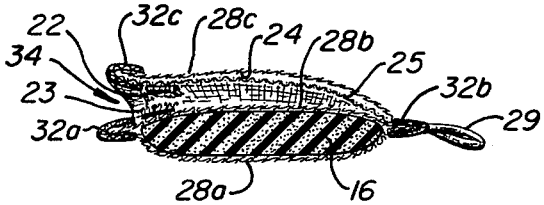
FIG. 3 is a cross sectional view taken on the lines 3—3 in FIG. 2.

The particular construction of the preferred embodiment is illustrated in FIGS. 1 and 2 and in the cross-sectional view of FIG. 3. The outer shape or configuration is not important to function, but, provides a pleasing shape to encourage use and display, preferably by hanging on a hook (not shown) from a hook loop 29. However, the manner of arranging the component parts is significant to proper functioning of the wash pad 10. The core of the wash pad as noted comprises a water and cleanser absorbant material 16 of open cell foam. This material is encased on both sides by a terry cloth outer cover piece **28*a* and inner liner piece 28*b* which are coupled on one edge with a closed overlock stitchery 32*a***. The casing may be fabricated from some other porous, preferrably water absorbant material, with a reduction in performance.

The other edge is coupled to the nylon webbing 25 and an additional outer pocket piece **28*c* of terry cloth material. The casing for the core material and both the pocket piece and webbing which are joined together by a contiguous closed overlock stitching 32*b*. The nylon webbing 25, and outer pocket piece 28*c* at the pocket opening 34, are similarly coupled by a closed overlock stitching 32*c***. The nylon webbing not only provides the activating medium for rapid foaming, but maintains the overall shape of the wash pad.

The pocket 18 has a closure comprising a matte or pile strip 22 sewn to the webbing and inside of the outer pocket piece 28*a* and a filament hooking strip sewn to the surface of the inner liner piece 28*b*. The pocket 18 is sufficiently large to contain a new or remnant bar of soap or the liquid cleanser with allowance for distribution throughout the adjacent foam material.

While on the foregoing embodiments of the invention have been set forth in considerable detail for the purposes of making a complete disclosure of the invention, it will be apparent to those of skill in the art that numerous changes may be made in such details without departing from the spirit and principles of the invention.

What is claimed is:

1. A wash pad having a pocket for receiving a cleanser comprising:

a core formed of a cleanser absorbant sponge material;

a casing covering said core, said casing having on one side a cloth cover piece and on the other side a liner piece of water porous material, said cover piece and liner piece being joined by stitching around their coupled edge;

a pocket constructed of an outer cloth pocket piece coupled to said casing over said liner piece by stitching around a substantial portion of the coupled edge leaving an opening for receiving a cleanser; and a porous webbing material having a characteristic of aiding in intersurface shear slippage, said webbing material being disposed between said pocket piece and said casing liner and contiguous therewith for rapid foaming of the cleanser when said wash pad is rubbed or squeezed.

2. The wash pad of claim 1 wherein said webbing material is stitched to said pocket piece, said said cover piece of said casing and said pocket piece are fabricated of a terry cloth material.

3. The wash pad of claim 2 wherein said liner piece of said casing is fabricated of a terry cloth material.

4. The wash pad of claim 1 wherein said pocket includes a closure for closing the pocket opening.

5. The wash pad of claim 4 wherein said closure comprises a first strip of adhesive material sewn to said liner piece of said casing adjacent the opening and a second strip of adhesive material sewn to said pocket piece over said webbing material, wherein when said strips of adhesive material are mutually contacted said strips form a closure.

6. The wash pad of claim 1 wherein said webbing material is nylon.

* * * * *